US006905528B2

(12) United States Patent
Rübenach

(10) Patent No.: US 6,905,528 B2
(45) Date of Patent: Jun. 14, 2005

(54) CONVEYING AIR FILTRATION SYSTEM

(75) Inventor: Bernhard Rübenach, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/390,772

(22) Filed: Mar. 19, 2003

(65) Prior Publication Data

US 2003/0183084 A1 Oct. 2, 2003

(30) Foreign Application Priority Data

Mar. 30, 2002 (DE) ..... 102 14 389

(51) Int. Cl.[7] ..... D01G 23/08

(52) U.S. Cl. ..... 55/337; 55/340; 55/345; 55/349; 55/452; 55/460; 95/268; 95/280; 209/27; 209/137; 209/250; 209/712; 209/719

(58) Field of Search ..... 55/302, 337, 340, 55/345, 349, 452, 460; 95/268, 280; 209/27, 137, 250, 712, 719

(56) References Cited

U.S. PATENT DOCUMENTS

| | | | | |
|---|---|---|---|---|
| 4,778,491 A | * | 10/1988 | Yow, Sr. | 55/307 |
| 4,878,784 A | | 11/1989 | Binder et al. | |
| 4,917,712 A | * | 4/1990 | Crigler | 55/304 |
| 5,641,339 A | * | 6/1997 | Johnson | 95/268 |
| 5,800,578 A | * | 9/1998 | Johnson | 95/268 |

FOREIGN PATENT DOCUMENTS

| | | |
|---|---|---|
| DE | 32 17 668 A1 | 1/1983 |
| DE | 39 19 744 A1 | 12/1990 |
| DE | 39 28 280 A1 | 2/1991 |
| DE | 39 28 752 A1 | 3/1991 |
| DE | 41 29 883 A1 | 3/1992 |
| EP | 0 563 700 A1 | 10/1993 |
| GB | 2 241 965 A | 9/1991 |
| GB | 2 248 637 A | 4/1992 |
| GB | 2 334 533 A | 8/1999 |

* cited by examiner

*Primary Examiner*—Minh-Chau T. Pham
(74) *Attorney, Agent, or Firm*—Venable LLP

(57) ABSTRACT

An arrangement used for filtering out conveying air when supplying fiber material to a processing machine is provided. The arrangement has an essentially vertical filling chute for the fiber material, the chute having an upper intake opening and a lower exit opening, a device with pneumatic fiber feed at the upper intake opening, and a flocculeforming device at the lower exit opening including a system of draw-in rolls and a fast-rotating opening roll. The chute includes at least one air-permeable surface for separating the fiber material from the conveying air. An evacuating device evacuates the filtered out conveying air. An exhaust air device is coupled to the evacuating device and has an air stream regulator which is connected to a control and regulating device. The conveying air stream is guided along the opening roll, and a partial air stream of the filtered out conveying air is guided into the exhaust air device.

20 Claims, 3 Drawing Sheets

CONVEYING AIR FILTRATION SYSTEM

CROSS-REFERENCE TO RELATED APPLICATION

This application claims priority to German Patent Application No. 102 14 389.7, filed Mar. 30, 2002, the disclosure of which is incorporated herein by reference.

BACKGROUND OF THE INVENTION

The invention relates to an arrangement used for filtering out the conveying air when supplying fiber material, for example cotton and the like, to a processing machine provided with an essentially vertical filling chute for the fiber material. A pneumatic fiber feed is assigned to the upper intake opening of the chute while a flocculation device, having a draw-in roll and a fast rotating opening roll, is assigned to the lower discharge opening. The processing machine is further provided with at least one air-permeable surface for filtering out (separating out) the fiber material from the conveying air stream and a device for evacuating the conveying air stream, wherein the conveying air stream is conducted along the opening roll.

In a known arrangement of this type, as shown in German Patent Document No. DE-OS 32 17 668, the total conveying air stream flows along the opening roll and into a downstream installed floccule chute with air-permeable wall surfaces. The conveying air stream is separated from the fiber floccules and is then evacuated while the fiber floccules are conveyed further with the aid of a roll. The conveying air stream is used for condensing the fiber floccules deposited in the floccule chute. In practical operations, the disadvantage of this method is that the air stream conveying the fiber floccules to the upper reserve chute fluctuates, so that the filtered out conveying air stream also fluctuates to a considerable degree.

SUMMARY OF THE INVENTION

Thus, it is an object of the invention to create an arrangement as described above, which avoids the aforementioned disadvantages. In particular, the arrangement should permit the pneumatic removal of the separated out fiber floccules to a downstream-connected device and make is possible to form a conveying air stream with constant or essentially constant volume.

This and other objects are achieved as a result of an arrangement used for filtering out conveying air when supplying fiber material to a processing machine. The arrangement has an essentially vertical filling chute for the fiber material, the chute having an upper intake opening and a lower exit opening, a device with pneumatic fiber feed at the upper intake opening, and a floccule-forming device at the lower exit opening that includes a system of draw-in rolls and a fast-rotating opening roll. The chute includes at least one air-permeable surface for filtering out the fiber material from the conveying air. An evacuating device evacuates the filtered out conveying air. An exhaust air device is coupled to the evacuating device and has an air stream regulator which is connected to a control and regulating device. The conveying air stream is guided along the opening roll, and a partial air stream of the filtered out conveying air is guided into the exhaust air device.

A constant or essentially constant conveying air stream is formed in that a partial air stream is split off from the filtered out conveying air stream and the volume of this partial air stream can be adjusted. In this way, the conveying air stream can be used for removing material from the opener, thereby reducing the energy and processing costs for the pneumatic material transport. Another advantage is that when using connected machinery for which the conveying air stream has a larger volume than the material-removing air stream, the conveying air stream is divided with the aid of the regulating system in such a way that the material-removing air stream has a constant volume.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
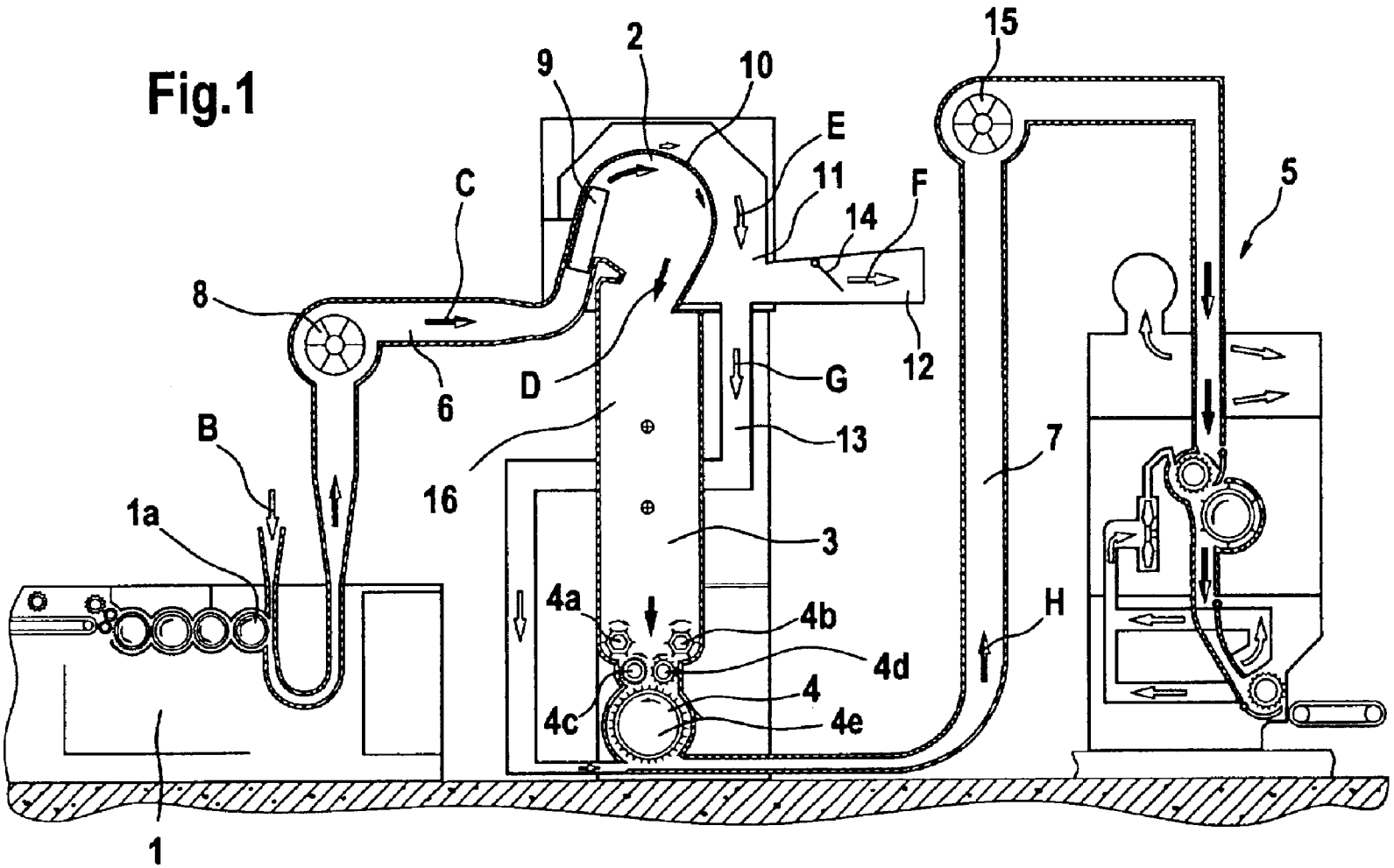
FIG. 1 is a schematic side elevation view of a portion of a spinning preparation plant including an arrangement according to the invention.

FIG. 1 shows a bale opener 1 (for example a TXL 4 bale opener by the Trützschler Company in Mönchengladbach, Germany), a fiber material separator 2 (for example a Tr ützschler material separator MAS), a fiber material collector 3 (for example a Trützschler material collector MSC) with opening device 4 (for example a metering opener), and a fiber floccule feeder 5 (for example a Trützschler SCANFEED), connected in series. In place of the opener 1, a cleaner such as a Trützschler cleaner CVT 4 can also be used.

A pipeline 6 is installed between the opener 1 and the material separator 2 for the pneumatic floccule transport and a pipeline 7 is installed between the metering opener 4 and the fiber floccule feeder 5. The fiber material is removed from the last roll la of the four-roll opening system 1 with the aid of an air stream B, which is suctioned in by a fiber-material transport ventilator 8, arranged inside the pipeline 6. The fiber floccule-air-mixture C is thrown with distribution flaps 9 against the inside wall surface of a perforated sheet 10 of the material separator 2. In the process, the fiber floccules D are separated from the conveying air E. The conveying air E travels to an exhaust air chamber 11 to which an exhaust-air duct 12 and an exhaust air line 13 are respectively connected with one end. One end of the exhaust-air duct 12 leads to the outside while the other end is connected to the pipeline 7. A pivoting flap 14 is installed inside the ventilation air duct 12 while a material transport ventilator 15 is arranged inside the pipeline 7.

A vertical floccule chute 16 with air-impermeable wall surfaces is arranged underneath the perforated sheet 10. The lower end of this chute is provided with the metering opener 4, comprising two condensing rolls 4*a*, 4*b*, two slow-rotating intake rolls 4*c*, 4*d* and one fast-rotating opening roll 4*e*. Since the uniform supply of the floccule feeder 5 is very important, the metering opener 4 is installed in front of the floccule feeder 5. The metering opener 4 ensures a continuous supply for the floccule feeder 5.

An arrangement is thus created for separating out the conveying air E when supplying a processing machine (not shown herein), for example a carding machine or roller card unit. The processing machine is provided with an essentially vertical filling chute 16 for the fiber material D, wherein a material separator 2, such as a device with pneumatic fiber feed, is assigned to the upper intake opening. The metering opener 4, as a device for the floccule formation, comprising the draw-in roll system 4*a* to 4*d* and the fast-rotating opening roll 4*e*, is assigned to the bottom exit opening. The arrangement furthermore comprises a sheet-metal air panel 10 with air-permeable surface for separating the fiber material D from the conveying air stream E and the exhaust air chamber 11, the exhaust air duct 12 and the exhaust-air line 13 for evacuating the conveying air stream E. A partial air stream F of the filtered out conveying air stream E enters the exhaust air duct 12 where the pivoting air flap 14 is installed for regulating the air stream. The conveying air stream E that is reduced by the partial air stream F enters the exhaust-air line 13 as air stream G and is conducted along the opening roll 4*e*. In the process, the air stream G supported by centrifugal force—blows the fiber floccules H that are removed from the opening roll 4*e* into the pipeline 7.

The arrangement according to the invention eliminates the disadvantage of not having clear, stationary amounts of air for a system of several connected machines, as shown in practical operations. To ensure a non-problematic operation, the amounts of air are adapted according to the invention to the requirements of the successively following machines, so that the conveying air can be used further for removing the fiber amounts processed in the machine. The volume flows are lowered for this by using the conveying air streams for removing the fiber material.

Figure 2:
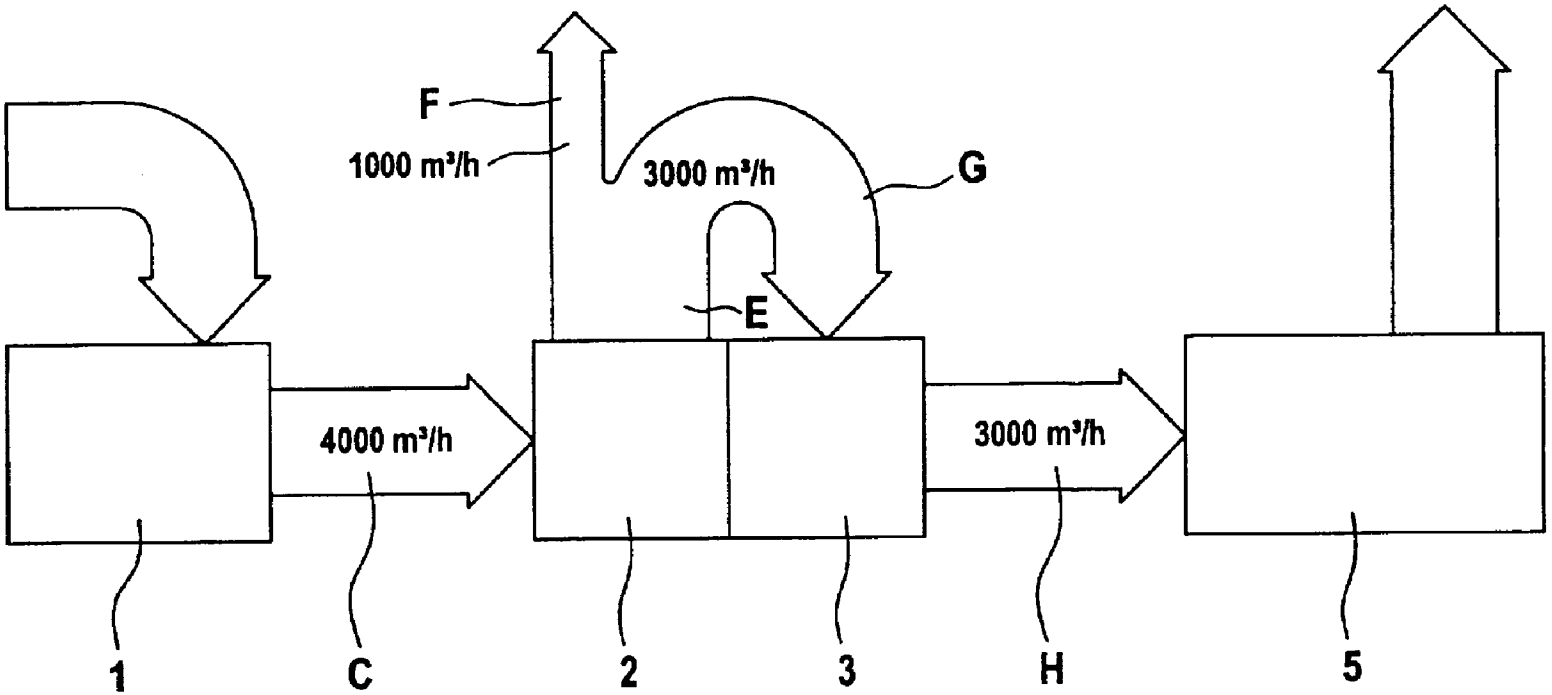
FIG. 2 is a block diagram of the plant according to FIG. 1, indicating a streams of air.

According to FIG. 2, a schematically indicated air stream flows from the preceding machine (not shown herein) into the opener 1. From the opener 1, a fiber-floccule transporting air stream C (e.g. 4000 $m^3$/h) enters the material separator 2 and flows as air stream E through the openings in the perforated sheet 10 and into the exhaust air chamber 11. The partial air stream F (e.g. 1000 $m^3$/h) is branched off from the air stream E into the exhaust line 12, so that the reduced air stream G (e.g. 3000 $m^3$/h) flows toward the opening roll 4*e*. From there, the air stream H loaded with floccules flows through the line 7 to the floccule feeder 5.

Figure 3:
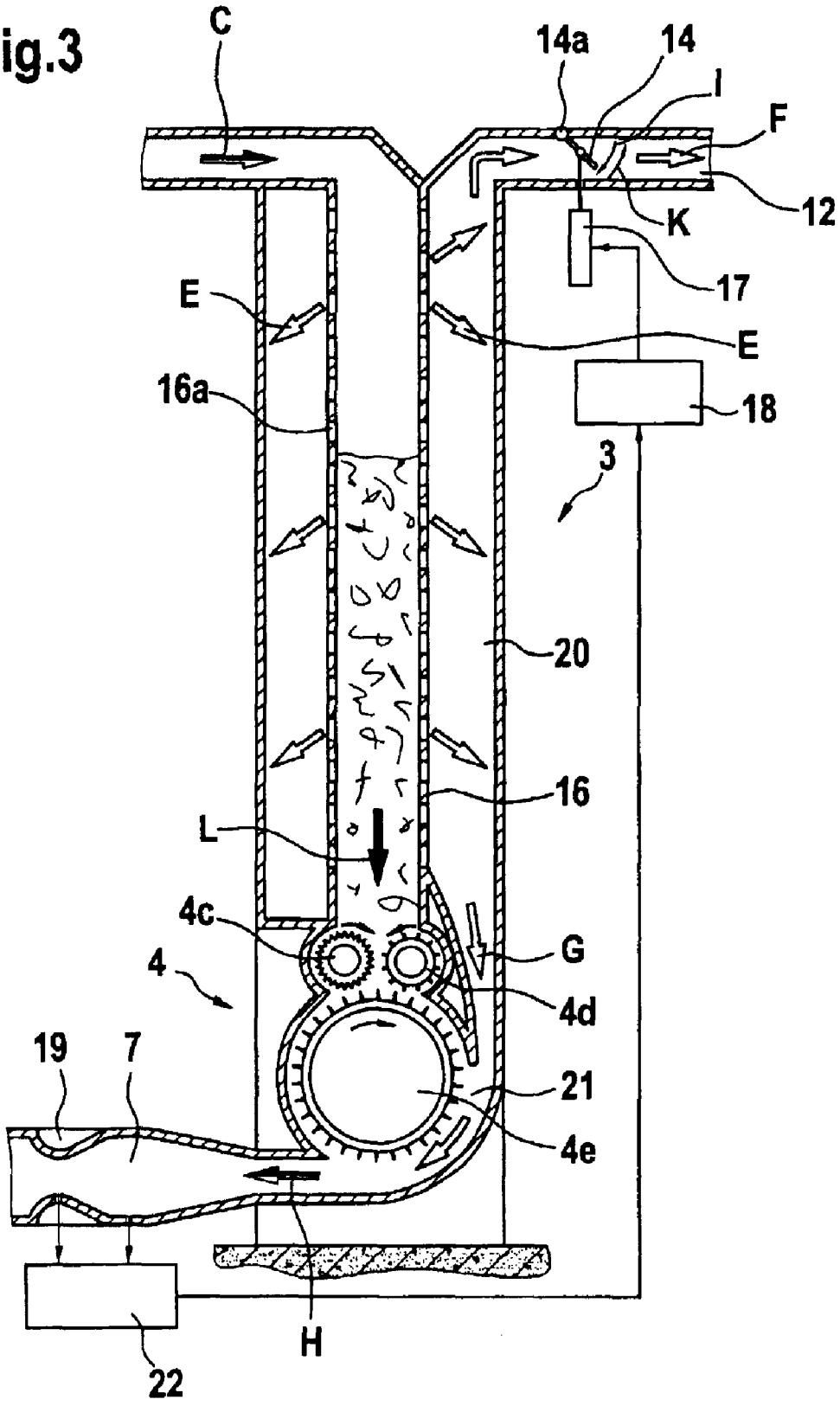
FIG. 3 is a side elevation view of an embodiment of an arrangement according to the invention.

According to FIG. 3, an opener 4 with integrated collector 3 is used in a fiber-processing plant. This opener 4 has a vertical feed chute 16 into which the material to be processed is blown with the aid of a conveying air stream C. To separate the material from the air, regions of the chute 16 are provided with comb-like or perforated sheet-type air exit openings 16*a* through which the conveying air stream can escape. The material L processed in the opener 4 is picked up by a second conveying air stream H behind the opening roll 4*e* and is supplied to the following machine. In this way, the conveying air stream is used for removing material from the opener 4, thus reducing the energy and processing costs of the pneumatic material transport. When using this principle for connected machinery where the supplying air stream C has a higher volume than the material-removing air stream H, the supplying air stream C is divided with the aid of a regulating system in such a way that the removing air stream H has a constant volume. For this, a pneumatic cylinder 17 is assigned as an adjustment element to the exhaust air flap 14, which can pivot around a rotating joint 14*a* in the direction of arrows I, K. The cylinder is connected via an electric control and regulating device to an air measuring element 19 that is assigned to the pipeline 7.

The air flow volume E, separated out via the air exhaust openings 16*a*, is then collected inside the machine in an evacuating device, for example, a collection chamber 20 and is supplied to the region of the opening roll. In the area where it is suctioned off, the air stream is transferred together with the opened material from the pipeline 7 to the next machine. To ensure that the pressure differences at the air exhaust surfaces and thus the volume of the air stream that passes through always remains below a critical value, a fresh air opening (exhaust air duct 12) allows suctioning off an air flow volume F to the surrounding area. However, this principle functions only if the volume of the air flow F to be suctioned off is lower than that of the supplying air flow volume E.

In many applications, a constant volume flow to the next machine is necessary because the filling level of the following machine can be detected only in this way via a pressure signal. In the process, the supplying air flow volume E is collected in chamber 20 to absorb the material opened in the suction duct 21. The exiting air flows through the volume measuring nozzle 19 (a measuring orifice or venturi tube), so that the material-removing air flow volume H can be determined in a measuring transducer 22 with the aid of the differential pressures and can be converted to a corresponding measuring signal. The generated measuring signal is supplied to the control unit 18, which activates the throttle valve 14 in dependence on a pre-adjusted desired value and via the adjustment unit 17. In dependence on the throttle valve adjustment, the excess air flow volume F can be adapted and fed to a material-removal device (for example a filter, thus ensuring a constant volume for the air flow H that further conveys the material and represents the difference between the volume flows C–F.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. An arrangement used for filtering out conveying air when supplying fiber material to a processing machine, the arrangement comprising:

an essentially vertical filling chute for the fiber material, the chute having an upper intake opening and a lower exit opening;

a device with pneumatic fiber feed at the upper intake opening;

a floccule-forming device at the lower exit opening comprising a system of draw-in rolls and a fast-rotating opening roll;

the chute including at least one air-permeable surface for filtering out the fiber material from the conveying air;

an evacuating device for evacuating the filtered out conveying air; and an exhaust air device coupled to the evacuating device and having an air stream regulator which is connected to a control and regulating device, wherein a first partial airstream of the filtered out conveying air stream is guided along the opening roll, and second partial air stream of the filtered out conveying air is guided into the exhaust air device.

2. The arrangement according to claim 1, wherein the filtered out conveying air stream is reduced by the second partial air stream to produce the first partial airstream, which is used for removing the fiber floccules from the opening roll.

3. The arrangement according to claim 1, wherein the first partial airstream of the filtered out conveying air stream is used for transporting the removed fiber floccules.

4. The arrangement according to claim 1, wherein the opening roll is connected to a device for pneumatic fiber removal.

5. The arrangement according to claim 4, wherein the device for pneumatic fiber removal comprises a removal duct.

6. The arrangement according to claim 5, wherein the device for pneumatic fiber removal is for connecting to the processing machine.

7. The arrangement according to claim 6, wherein the device for pneumatic fiber removal is connected to a suction-air source.

8. The arrangement according to claim 1, wherein the first partial airstream of the filter out conveying air stream is guided essentially tangentially along the opening roll.

9. The arrangement according to claim 8, wherein the first partial airstream of the filter out conveying air stream flows through a duct which is provided with a wall opening for a portion of the opening roll.

10. The arrangement according to claim 1, wherein the exhaust air device is an exhaust air chamber.

11. The arrangement according to claim 1, wherein the air stream regulator includes a flap.

12. The arrangement according to claim 11, wherein the flap can be moved to selected blocking positions for creating air resistance.

13. The arrangement according to claim 12, wherein the flap is connected to an adjustment mechanism.

14. The arrangement according to claim 13, wherein the adjustment mechanism comprises a compressed-air cylinder.

15. The arrangement according to claim 13, wherein the adjustment mechanism has a controllable motor.

16. The arrangement according to claim 13, further comprising a measuring device for measuring a volume of the first partial air stream.

17. The arrangement according to claim 16, wherein the measuring device is a venturi tube.

18. The arrangement according to claim 17, wherein the measuring device is connected to a measuring transducer which converts values measured by the measuring device into electrical signals.

19. The arrangement according to claim 18, wherein the measuring transducer is connected to an electrical control and regulating device, and the adjustment mechanism is connected to the electrical control and regulating device.

20. The arrangement according to claim 2, wherein the first partial airstream of the filter out conveying air stream that conveys the removed fiber floccules has an essentially constant volume.

* * * * *